US005093942A

United States Patent [19]

Lang

[11] Patent Number: 5,093,942

[45] Date of Patent: Mar. 10, 1992

[54] EXTENDIBLE AND RETRACTABLE SPA JET

[76] Inventor: Harold Lang, 802 Twin Hills, Houston, Tex. 77071

[21] Appl. No.: 606,884

[22] Filed: Oct. 30, 1990

Related U.S. Application Data

[63] Continuation-in-part of Ser. No. 383,670, Jul. 21, 1989, Pat. No. 5,027,450.

[51] Int. Cl.[5] ..... A61H 33/02

[52] U.S. Cl. ..... 4/542; 4/568; 239/197

[58] Field of Search ..... 4/492, 541, 542, 544, 4/567, 568, 570, 601, 605; 239/197, 588

[56] References Cited

U.S. PATENT DOCUMENTS

| | | | |
|---|---|---|---|
| 2,772,421 | 12/1956 | Friend | 4/544 |
| 3,182,336 | 5/1965 | Greuter | 4/570 |
| 3,806,964 | 4/1974 | Vanegas et al. | 4/542 |
| 4,144,898 | 3/1979 | Guignon et al. | 239/197 X |
| 4,424,598 | 1/1984 | Cima | 4/541 X |
| 4,449,260 | 5/1984 | Whitaker | 4/490 |
| 4,458,676 | 7/1984 | Pileggi | 128/66 X |
| 4,582,257 | 4/1986 | Siegler | 239/197 |

FOREIGN PATENT DOCUMENTS

| | | | |
|---|---|---|---|
| 459502 | 1/1937 | United Kingdom | 4/570 |
| 766508 | 1/1957 | United Kingdom | 239/197 |

*Primary Examiner*—Henry J. Recla
*Assistant Examiner*—Robert M. Fetsuga
*Attorney, Agent, or Firm*—Kenneth A. Roddy

[57] ABSTRACT

An extendible and retractable spa jet in the retracted position resides in the side wall of a hydrotherapy tub or shower stall and is connected to, and operated by, the existing pressurized water and/or air supply. In the retracted position it serves as a conventional fixed jet. When desired, it may be pulled outwardly from the side wall of the hydrotherapy tub or shower stall and used as a hand-held massage device to achieve concentrated, intensified massaging action at localized areas of the body not possible with fixed spa jets and shower heads.

18 Claims, 3 Drawing Sheets

EXTENDIBLE AND RETRACTABLE SPA JET

CROSS REFERENCE TO RELATED APPLICATION

This application is a continuation-in-part of co-pending application Ser. No. 07/383,670 now U.S. Pat. No. 5,027,450.

BACKGROUND OF THE INVENTION

1. Field of the Invention

This invention relates generally to water massage devices, and more particularly to an extendible and retractable spa jet which in the retracted position resides in the side wall of a hydrotherapy tub or shower stall and may pulled outwardly therefrom to be used as a hand-held massage device.

2. Brief Description of the Prior Art

Hot tubs and spas are well known for injecting aerated streams of water that have a therapeutic massaging effect on the body of the occupant. The therapeutic action of the tubs or spas is achieved by the vibrating action of bubbles and forceful circulation of water produced by jet nozzles positioned in the side walls of the spa or tub. However, the location of these jets allows the occupant to juxtapose primarily the back of the neck, shoulders, and back to the jets and, for the most part makes it impossible to achieve concentrated, intensified massaging action at other localized areas of the body.

Hand-held water sprayer heads and fluid powered vibrating heads which connect to faucets of household water systems are also known, but they are not particularly suited for operation or use in a submerged body of water.

There are several patents which disclose various massage devices for use in spas or hot tubs.

Sievers, U.S. Pat. No. 4,313,432 discloses a water driven personal massager for use in spas, hot tubs and the like which is connected to and driven vibrationally by the pressurized water supply of the spa or tub. The device comprises a conduit for connection to the pressurized water supply, a nozzle to direct the pressurized water across an eccentrically weighted turbine or waffle plate within a hand holdable massager head.

Marshall, U.S. Pat. No. 4,430,762 discloses an aquassage apparatus comprising a length of perforated bendable tubing having suction cups secured to the bottom which is installed in conventional bath tubs. The exhaust port of a vacuum cleaner is connected at one end of the tubing and controlled by a valve to agitate the water in the tub.

Pileggi, U.S. Pat. No. 4,458,676 discloses a portable hand held massager in combination with a spa. The massager has a fluid motor that is mechanically connected to a reciprocating massage pad. The fluid motor is detachably connected to the pressurized fluid system of the spa, and has a sleeve adapter to attach to a jet nozzle in the wall of the spa with a flexible hose leading to the motor of the massage unit.

Stearns, III, U.S. Pat. No. 4,640,462 discloses a hand-held water driven shower massager which includes a housing having an internally disposed rotatable nozzle which is caused to rotate by the high velocity discharge of water from the nozzle. An oscillating vibrational motion is applied to the entire device by eccentrically weighting the discharge nozzle, and provides a massaging effect when pressed against the body of the user.

When held away from the user, the unit functions as a source of water spray for cleansing.

Karp, British patent No. 766,508 discloses a reel unit for use with a bathroom fixture. The reel comprises a valve for regulating the supply of hot and cold water from the fixture, a unitary mixing chamber, separate means connecting the output side of the hot and cold valve means to the mixing chamber, and a flexible hose wound on the reel and connected to the mixing chamber for drawing mixed hot and cold water from the chamber when the hose is extended.

The present invention is distinguished over the prior art in general, and these patents in particular by an extendible and retractable spa jet which is connected to, and operated by, the existing pressurized water supply. In the retracted position, the jet resides in the side wall of a hydrotherapy tub or shower stall and serves as a conventional fixed jet. When desired, it may be pulled outwardly from the side wall of the enclosure and used as a hand-held massage device to achieve concentrated, intensified massaging action at localized areas of the body not possible with fixed spa jets or shower heads.

SUMMARY OF THE INVENTION

It is therefore an object of the present invention to provide an extendible and retractable spa jet which in the retracted position resides in the side wall of a hydrotherapy tub or shower stall to serve as a conventional fixed jet and may also be pulled outwardly therefrom to be used as a hand-held massage device.

It is another object of this invention to provide an extendible and retractable spa jet which is operated by the existing pressurized water supply of a hydrotherapy tub or shower stall.

Another object of this invention is to provide a extendible and retractable spa jet is easily installed in the side wall of a hydrotherapy tub or shower stall and connected to the existing pressurized water supply by simple connections.

Another object of this invention is to provide a extendible and retractable spa jet is easily installed in the side wall of a hydrotherapy tub or shower stall and connected to the existing pressurized water supply and will expel a mixture of air and water.

A further object of this invention is to provide an extendible and retractable spa jet which makes it possible to achieve concentrated, intensified massaging action at localized areas of the body not possible with fixed spa jets or shower heads.

A still further object of this invention is to provide an extendible and retractable spa jet which is simple in design and construction, economical to manufacture, and rugged and durable in use.

Other objects of the invention will become apparent from time to time throughout the specification and claims as hereinafter related.

The above noted objects and other objects of the invention are accomplished by an extendible and retractable spa jet which is connected to, and operated by, the existing pressurized water supply. In the retracted position, the jet resides in the side wall of a hydrotherapy tub or shower stall and serves as a conventional fixed jet. When desired, it may be pulled outwardly from the side wall of the enclosure and used as a hand-held massage device to achieve concentrated, intensified massaging action at localized areas of the body not possible with fixed spa jets.

DESCRIPTION OF THE PREFERRED EMBODIMENT

The present extendible and retractable spa jet is installed in hydrotherapy tubs of conventional construction with a side wall and a bottom wall and has a plurality of openings in the side wall to receive conventional fluid jet nozzles which communicate with one or more fluid distribution conduits. The hydrotherapy tub includes a water circulation system conventional in the art. The typical hydrotherapy tub or spa water circulation system includes a return line from a drain or outlet of the tub enclosure which leads to a pump. The pump discharge is connected to the water distribution conduit which is in open communication with each of the plurality of conventional jet nozzles. In most conventional spa or tub water circulation systems, air is introduced into the pressure water line prior to the discharge of the water as a jet into the spa. In some systems, air is inducted into the nozzle by the Venturi principle and in other systems, air may be supplied with a blower.

It should be understood that the spa or tub may utilize one or more extendible and retractable jets, as described hereinafter, in combination with conventional fixed jets or may utilize all extendible and retractable jets.

Figure 1:
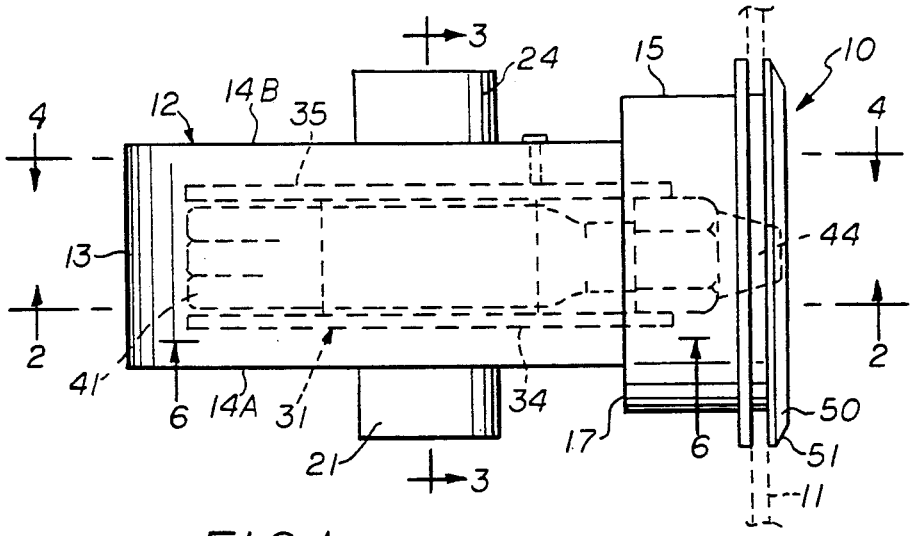
FIG. 1 is a top plan view of an extendible and retractable spa jet in accordance with the present invention.
Figure 2:
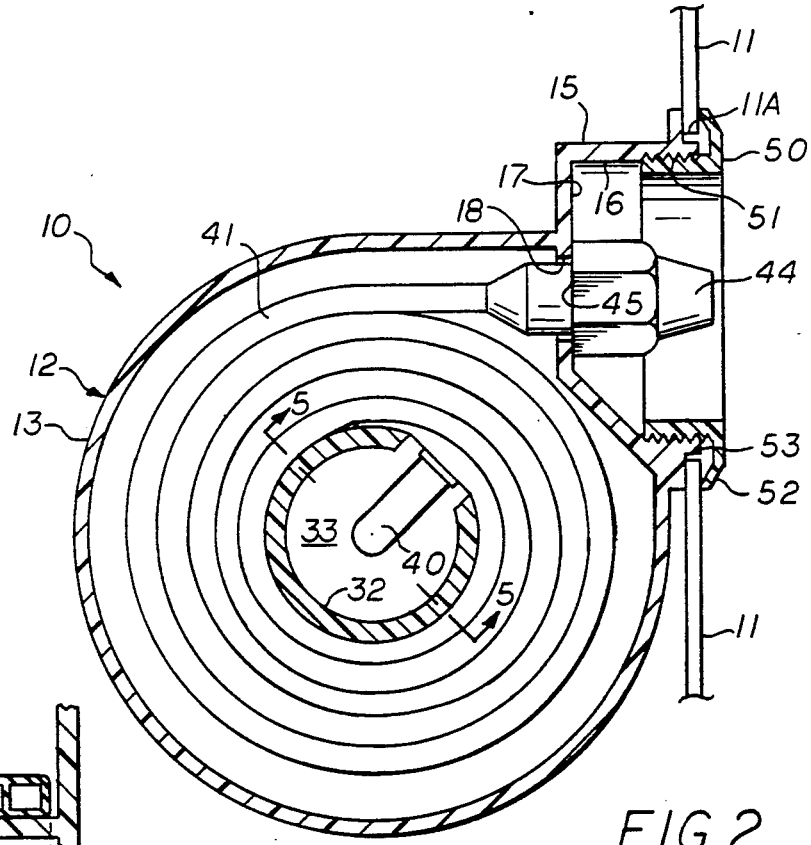
FIG. 2 is a side elevation in cross section of the extendible and retractable spa jet taken along line 2—2 of FIG. 1.
Figure 3:
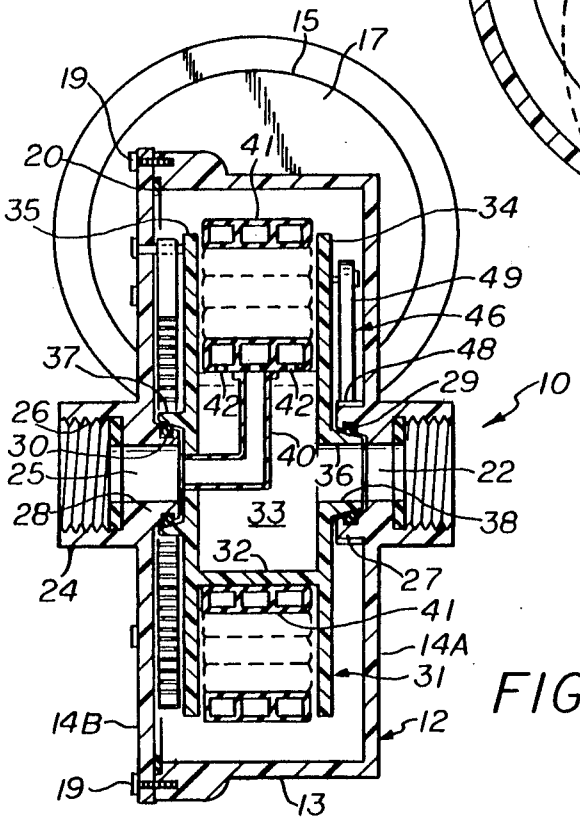
FIG. 3 is a cross section view of the extendible and retractable spa jet taken along line 3—3 of FIG. 1.

Referring to the drawings by numerals of reference, there is shown in FIGS. 1, 2 and 3, a preferred extendible and retractable spa jet 10 attached to the side wall 11 of a spa or tub such as described above. The extendible and retractable spa jet 10 comprises a hollow, generally cylindrical or disc-like housing 12 having a curved circumferential outer wall 13 and laterally opposed side walls 14A and 14B. A generally cylindrical portion 15 extends outwardly a short distance from the periphery of the housing 12 and defines a cylindrical cavity 16 which extends inwardly from one end and terminates in a back wall 17. An aperture 18 extends through the back wall 17.

As best seen in FIG. 3, for assembly and maintenance, at least one of the side walls 14B may be removably connected to the circumferential wall 13 by screws 19 or other conventional fastening means with a suitable water seal 20 therebetween. Thus, the housing 12 is a water-tight chamber. One of the side walls 14A has an outwardly extending central boss 21 which has a bore 22 therethrough and is provided with internal threads 23 for connecting the housing to the existing water supply and serving as the water inlet.

Similarly, the other side wall 14B has an outwardly extending central boss 24 which has a bore 25 therethrough and is provided with internal threads 26. The boss 24 serves as a air inlet and may be optionally connected to a source of pressurized air, or may be left open for drawing air in from atmosphere, or may simply be plugged or capped, if the jet system does not use air.

The inner surfaces of the side walls 14A and 14B are provided with laterally opposed raised bosses 27 and 28 which extend inwardly in axial alignment. The extended ends of the raised bosses 27 and 28 are configured to receive the hub portion of a reel. As shown in FIG. 3, the raised boss 27 is provided with conical recess, and the raised boss 28 is provided with a conical exterior. A rotary fluid seal 29 is installed in the recess of boss 27 and a rotary fluid seal 30 is installed on the exterior of boss 28.

A spool-like reel 31 is rotatably mounted in the housing 12 between the side walls 14A and 14B. The reel 31 has a central hub portion having a cylindrical wall 32 defining a central chamber 33 in the reel. A pair of parallel radial flanges 34 and 35 are spaced laterally to opposite sides of the reel chamber 33. The outer surfaces of the flanges 34 and 35 are provided with laterally opposed bosses 36 and 37 which extend outwardly in axial alignment. The extended ends of the raised bosses 36 and 37 are rotatably engaged on the raised bosses 27 and 28 of the housing side walls 14A and 14B. As shown in FIG. 3, the raised boss 37 is provided with a conical recess, and the raised boss 38 is provided with a conical exterior. The seals 29 and 30 form a rotary fluid sealing relation with the bosses 36 and 37 of the reel.

Figure 5:
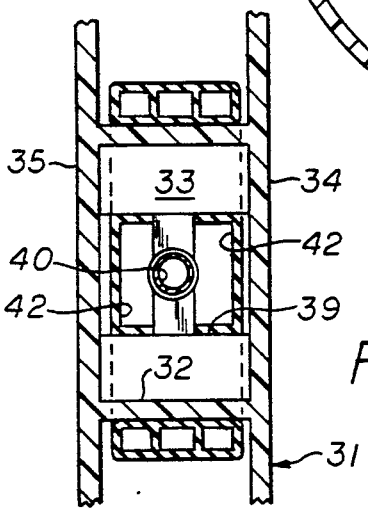
FIG. 5 is a cross section through the center portion of the reel of the extendible and retractable spa jet taken along line 5—5 of FIG. 2 showing the hose connection.

A bore 38 extends through the raised boss 36 in axial alignment with the bore 22 allowing water to enter the central chamber 33 of the reel 31. As shown in FIGS. 2 and 5, the side wall 32 of the chamber 33 has a cut-out portion or aperture 39. A generally L-shaped tubular conduit 40 has one end connected to the reel flange 35 and its other end extending into the aperture 39 to form an isolated air passageway through the chamber 33.

A length of flexible hose 41 is secured at one end to the side wall 32 of the reel chamber 33 and covers the aperture 39. The inward end of the hose 41 is sealed closed. As shown in FIGS. 3 and 5, the preferred hose 41 has a generally flat rectangular cross section, and is divided into three separate tubular compartments, similar to a lawn "soaker" hose. The center compartment may carry air, and the two outer compartments carry water. As seen in FIG. 5, the outer compartments of the hose 41 are slotted 42 and the hose is sealed all around the aperture 39, such that water will enter the water compartments of the hose 41 from the chamber 33 via the slots 42. The center compartment of the hose 41 is connected to the extended end of the tubular conduit 40 and sealed around the connection such that air may enter the center compartment of the hose from the air inlet 24.

It should be understood, that the air passageway is an option, and that a hose having only a single compartment may be used to carry water, or that a hose having three compartments each carrying water may be used.

The hose is wound on itself in convolutions around the chamber wall 32 within the flanges 34 and 35. The outer end of the flexible hose 41 is slidably received through the aperture 18 in the back wall 17 of the cavity 16 of the cylindrical portion 15. The housing 12 is normally installed below the normal water level in a tub or spa, and a seal around the hose aperture 18 is not required. In other words, since the housing is water-tight, water may be allowed to into the housing from the spa or tub.

The reel 31 is disposed relative to the cylindrical portion 15 of the housing such that the outer end (or top convolution) of the flexible hose 41 will spool off the reel 31 and pass through the aperture 18 in a generally axially aligned relation to prevent binding.

Figure 4:
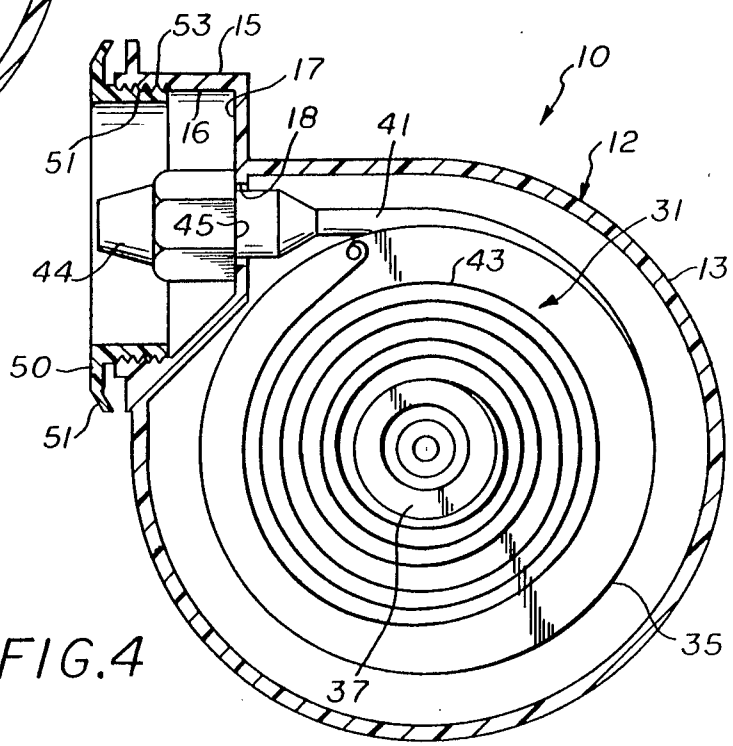
FIG. 4 is a side elevation in cross section of the extendible and retractable spa jet taken along line 4—4 of FIG. 1 showing the retractable spring mechanism.

As seen in FIG. 4, a coiled spring 43 has one end fixed to the raised boss 37 on the outer side of the radial flange 35 and is loosely wound therearound and the other end o the spring 43 is fixed to the housing side wall 14B. The preferred spring 43 is formed of water resistant material, since the interior of the housing 12 will be substantially filled with water. The spring 43 is wound such that the hose 41 is spring biased in a normally retracted wound position, and when pulled outward will spool off the reel 31 as the reel rotates.

A nozzle 44 is secured to the free end of the hose 41. The nozzle 44 preferably has a flat radial shoulder 45 at its connection with the hose 41 and an exterior configured to be easily gripped by the hand of the user. A bore (not shown) extends through the nozzle 44 in communication with the hose interior compartments. The nozzle 44 is of conventional construction and may be configured internally to expel the water and/or air passing therethrough forcefully in a jet stream of water or a mixture of water and air. The flat shoulder 45 of the nozzle 44, in the retracted position, will engage the back wall 17 to maintain the nozzle within the cavity of the cylindrical portion 15.

Figure 6:
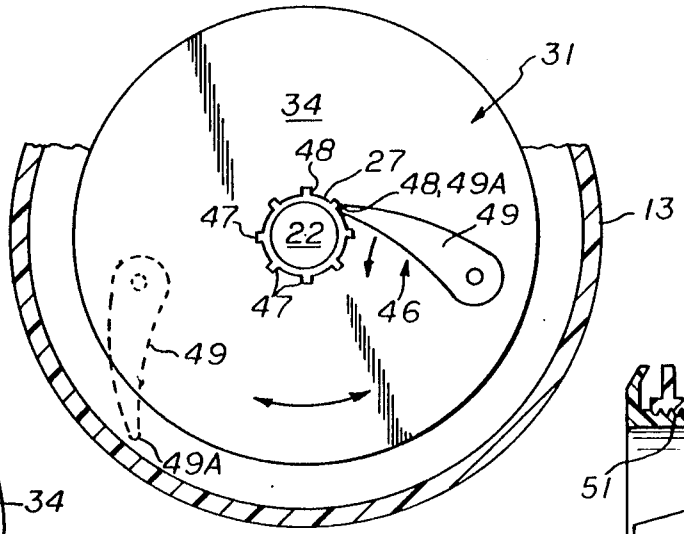
FIG. 6 is a side elevation of the reel of the extendible and retractable spa jet taken along line 6—6 of FIG. 1 showing the ratchet and pawl latch mechanism.

A seen in FIGS. 3 and 6, a centrifugal latch mechanism 46 is installed on the reel flange 34 to maintain the nozzle 44 in a selective outwardly extended position. It should be understood that various conventional latching mechanisms may be adapted to control the extended position of the nozzle, and the following description is but one example of a simple ratchet latch mechanism.

The inwardly facing boss 27 on the side wall 14A is provided with a series of radially extending raised protrusions or teeth 47 and serves as a stationary ratchet ring which encircles the water inlet hole 22. The toothed surfaces 47 have flat surfaces 48 on their clockwise side as seen in FIG. 6. A pawl member 49 is pivotally pinned on the outer surface of the reel flange 34 to rotate with the reel 31 as the hose 41 is spooled on and off. The free end of the pawl 49 is shaped to ride on the raised protrusions or teeth 47 of the ratchet ring boss 27 when the reel 31 rotates in one direction (spooling off), and to engage the flat surfaces 48 of the teeth when the reel rotates in the opposite direction (retracting).

When the nozzle 44 is pulled slowly outward from the housing 12, the hose 41 will spool off the reel 31 and gravity drops the free end 49A of the pawl 49 out of engagement with the ratchet ring boss 27 and the free end of the pawl will ride over the teeth 47. When tension on the hose 41 is released, the spring 43 causes the reel 31 to rotate in the opposite direction (retract), and the free end 49A of the pawl 49 will engage the flat surfaces 48 of the teeth 47 to prevent further rotation. When the nozzle 44 is pulled out and quickly released, the free end 49A of the pawl 49 will pivot radially outward and disengage from the ratchet ring teeth 47 due to centrifugal force, thus allowing the hose and nozzle to be fully retracted to its stored position.

Referring again to FIGS. and 2, a trim ring 50 is provided for securing the housing 12 onto the side wall 11 of the tub or spa. The trim ring 50 is a hollow cylindrical member having external threads 51 and a radially extending flange 52 and may or may not have seal element therebetween. The housing 12 is placed on the exterior of the tub enclosure side wall 11 in axial alignment with the existing jet nozzle openings 11A. If nozzle openings do not exist in the side wall 11, then they may be formed therein by conventional methods. The trim ring 50 is threadedly engaged with internal threads 53 on the interior of the housing cylindrical cavity 16 and tightened to engage the trim ring 50 with the interior surface of the tub side wall 11. The water supply inlet 21 is then connected to the existing water discharge conduit of the existing water circulation system.

If air bubbles are desired to create more turbulence, the air inlet boss 24 may be left open to draw air in from atmosphere, or may be connected an existing air source if one exists in the system. If air bubbles are not desired, the air inlet 24 may be plugged or capped.

It should be understood that the air inlet feature is an option, and the present retractable spa jet may be manufactured constructed without the air inlet and passageways, etc., and that a hose having only one compartment may be used to carry water, or that a hose having three compartments each carrying water may be used.

The spa jet 10 may also be used in installations where the housing 12 is not disposed beneath the normal water level, such as on a wall, or in a wall wherein it would not be desirable to allow water to enter the chamber 33. In these types of installations, the air inlet 24 and tubular conduit 40 may be connected to the water supply and water would flow from the source through the inlet 24 and tubular conduit 40 to provide an isolated water flow path through the chamber 33.

Figure 7:
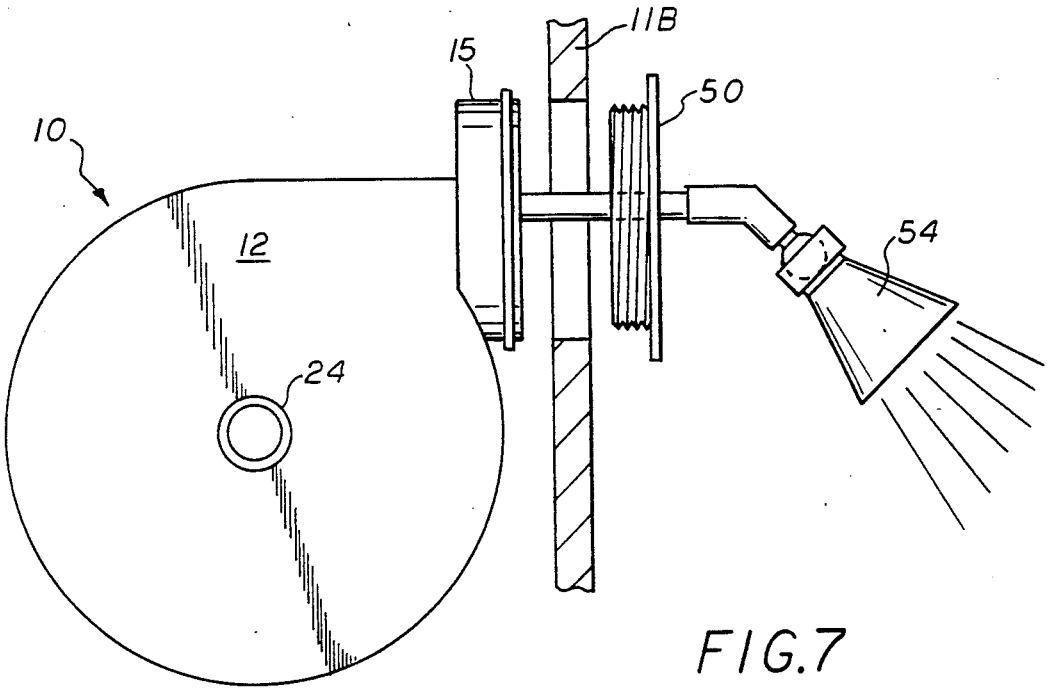
FIG. 7 is a side elevation showing an extendible and retractable spa jet installed in the wall of a shower or tub and having a shower head type of nozzle.

As seen in FIG. 7, the housing 12 of the spa jet 10 may be installed in the wall 11B of a shower or tub and have a pulsating or standard shower head type of nozzle 54 installed in place of the spa jet type nozzle 44. In this application, the inlet 24 would be connected to the existing shower outlet fitting of the faucet by a length of conduit whereby the proper mixture of hot and cold water could be selected.

The housing 12 of the spa jet 10 may also be mounted by conventional mounting means to the exterior of the wall of a shower or tub and have a pulsating or standard shower head type of nozzle installed in place of the spa jet type nozzle. In this application, the inlet 24 would be connected to the shower arm pipe by a length of conduit.

Figure 8:
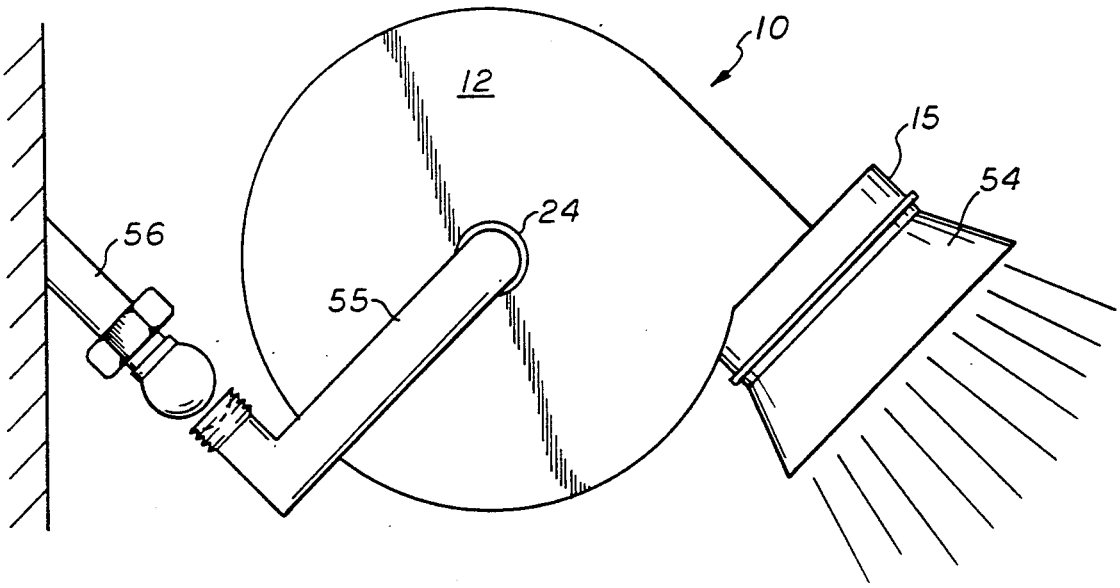
FIG. 8 is a side elevation showing an extendible and retractable spa jet installed on a shower arm and having a shower head type of nozzle.

As seen in FIG. 8, an adapter conduit 55 may be provided which has one end connected to the inlet 24 on the housing 12 and its other end adapted to be connected to the outer end of the existing shower arm pipe 56.

While this invention has been described fully and completely with special emphasis upon a preferred embodiment, it should be understood that within the scope of the appended claims the invention may be practiced otherwise than as specifically described herein.

I claim:

1. An extendible and retractable jet apparatus for use in hydrotherapy tubs of the type having at least one side wall forming an enclosure containing a body of water at a normal water level and a pressurized fluid distribution system including a discharge conduit, the jet apparatus comprising;

a hollow disc-like housing having spaced apart side walls and a circumferential outer wall defining a central chamber, said outer wall having an inwardly extending cylindrical cavity which terminates in a back wall having an aperture extending therethrough and said housing adapted for connection to the exterior of the enclosure side wall over an aperture formed therein below the normal water level and in fluid communication with the enclosure interior fluid inlet means on at least one said housing side wall adapted for connection to the discharge conduit of the pressurized fluid distribution system, a hose reel rotatably mounted in said housing between said side walls for receiving and dispensing a length of flexible hose and having a hollow cylindrical central hub portion in sealed fluid communication with said housing fluid inlet means and a fluid outlet means in said hub portion, a length of flexible hose connected at one end to said hose reel fluid outlet means to establish a fluid flow path from said housing fluid inlet and through said reel central hub portion to the interior of said hose, the free end of said length of flexible hose extending reciprocally through said housing cavity back aperture and in a stored position being contained within said housing cavity and capable of being extended outwardly a distance therefrom in an extended position, a nozzle member secured to the free end of said length of flexible hose and adapted to be received and engaged in said housing cavity in the stored position and configured to expel fluid passing therethrough forcefully in a jet stream of fluid, whereby said nozzle member in the stored position within said housing cavity resides adjacent to the interior of the side wall of the hydrotherapy tub or shower stall and operates as a fixed jet and ma be manually pulled outwardly therefrom to the extended position and used as a hand-held massage device to achieve concentrated, intensified massaging action at localized areas of the body of the user.

2. An extendible and retractable jet apparatus according to claim 1 in which;

said housing outer wall having a generally cylindrical portion extending outwardly a short distance from the periphery of said housing to define said inwardly extending cylindrical cavity and said generally cylindrical portion adapted for connection to the exterior side of the enclosure side wall of the hydrotherapy tub.

3. An extendible and retractable jet apparatus according to claim 1 in which;

at least one of said housing side walls is removably connected to said circumferential outer wall, and including seal means disposed between said removable side wall and said outer circumferential wall.

4. An extendible and retractable jet apparatus according to claim 1 in which;

said hose reel comprises a pair of cylindrical flanges spaced laterally at opposite sides of said hub portion.

5. An extendible and retractable jet apparatus according to claim I in which;

each said housing side wall has axially aligned reel support means on their opposed inner surfaces for rotatably receiving said hose reel.

6. An extendible and retractable jet apparatus according to claim 5 in which;

said hose reel comprises a spool-like reel including said hollow cylindrical central hub portion having a circumferential side wall, and a pair of cylindrical flanges spaced laterally at opposite ends of said hub portion, each said flange rotatably engaged on said housing side wall support means, and said housing fluid inlet means including at least one pair of said support means and said flange.

7. An extendible and retractable jet apparatus according to claim 6 including;

rotary seal means between said reel flanges and said housing side wall support means forming a rotary fluid sealing relation therebetween.

8. An extendible and retractable jet apparatus according to claim 6 in which;

said reel fluid outlet means comprises at least one aperture through said hub portion circumferential side wall, said hose end connected to said reel has at least one aperture therethrough in alignment with said reel hub aperture, and a tubular conduit having one end connected to the other pair of said support means and said flange reel flange fluid inlet and its other end connected through said hub portion aperture to said hose aperture, said apertures and said tubular conduit sealed to form an isolated fluid passageway between the other pair of said support means and said flange and the interior of said hose.

9. An extendible and retractable jet apparatus according to claim 1 in which;

said reel fluid outlet means comprises an aperture through said hub portion, and said hose end connected to said reel has an aperture therethrough in alignment with said reel hub aperture, and said apertures are sealed together to form a fluid passageway between the interior of said reel hub portion and the interior of said hose.

10. An extendible and retractable jet apparatus according to claim 7 in which;

said fluid passageway extends from said fluid inlet means into said reel central hub portion for allowing fluid to enter said reel central hub portion.

11. An extendible and retractable jet apparatus according to claim 1 in which;

said length of flexible hose having a generally rectangular cross section and sealed closed at its end secured to said fluid outlet means, and said hose end connected to said fluid outlet means having at least one aperture therethrough in communication with said fluid outlet means.

12. An extendible and retractable jet apparatus according to claim 1 in which:

said length of flexible hose having a generally rectangular cross section divided transversely into at least two longitudinal tubular compartments extending substantially its length, and said hose sealed closed at its end secured to said fluid outlet means having at least one aperture therethrough in communication with said fluid outlet means.

13. An extendible and retractable jet apparatus according to claim 12 in which;

said reel fluid outlet means comprises at least two apertures through said hub portion circumferential side wall, said hose end connected to said fluid outlet means including an aperture therethrough in each said compartment in alignment with said reel hub apertures and one of said hub portion apertures is sealed to one of said hose apertures to form a first fluid passageway between the interior of said reel hub portion and the interior of said hose for carrying one type of fluid, and a tubular conduit having one end connected to said fluid inlet means and its other end connected through another said hub portion side wall aperture to said hose aperture in another said hose compartment and said apertures and said tubular conduit sealed to form a second fluid passageway between the fluid inlet means and the interior of said hose which is isolated from said first passageway for carrying another type of fluid, whereby said hose will simultaneously carry two types of fluid.

14. An extendible and retractable jet apparatus according to claim 13 in which;

said length of flexible hose having a generally rectangular cross section divided transversely into three longitudinal tubular compartments extending substantially its length, and said tubular conduit is sealingly connected to said center compartment.

15. An extendible and retractable jet apparatus according to claim 1 including at least one spring member operatively mounted between said housing and said reel such that said length of flexible hose is spring biased in a normally retracted wound position o said reel and when pulled outward will spool off said reel as said reel rotates.

16. An extendible and retractable jet apparatus according to claim 1 including releasable latch means operatively connected between said housing and said reel such that the free end of said length of flexible hose may be releasably maintained in a selective extended position.

17. An extendible and retractable jet apparatus according to claim 1 in which said housing fluid inlet means is adapted to be connected to a shower arm discharge pipe.

18. In combination with a hydrotherapy tub of the type having at least one side wall forming an enclosure containing a body of water at a normal water level and a pressurized fluid distribution system including a discharge conduit fluidly connected to the enclosure side wall below the normal water level and to a pressurized fluid source for circulating fluid into the body of water, at least one fluid jet extendibly and retractably received in a housing mounted over an aperture formed in said enclosure side wall below the normal water level and including a length of flexible hose connected at one end in fluid communication with said discharge conduit and a nozzle member at its free end configured to forcefully expel fluid passing therethrough in a jet stream of fluid, said nozzle member being manually movable between a stored position within said housing residing adjacent the interior of the side wall of the enclosure to operate as a fixed jet and an extended position outwardly from said side wall to be used as a hand-held massage device to achieve concentrated, intensified massaging action at localized areas of the body of an occupant of the enclosure.

* * * * *